United States Patent [19]

Crowe

[11] Patent Number: 4,653,803

[45] Date of Patent: Mar. 31, 1987

[54] SETTEE SEATING UNIT AND SETTEE-CLUSTER FRAMES THEREFOR

[76] Inventor: Scott D. Crowe, 45 Jody La., Camarillo, Calif. 93010

[21] Appl. No.: 489,026

[22] Filed: Apr. 27, 1983

[51] Int. Cl.[4] ..... A47C 3/04

[52] U.S. Cl. ..... 297/158; 297/239; 108/91

[58] Field of Search ..... 297/239, 132, 157, 158; 108/91; 211/188

[56] References Cited

U.S. PATENT DOCUMENTS

| | | | |
|---|---|---|---|
| D. 97,086 | 10/1935 | Mintz | 297/172 X |
| D. 282,130 | 1/1986 | Crowe | D6/491 |
| D. 282,608 | 2/1986 | Crowe | D6/337 |
| 2,478,118 | 8/1949 | Mills | 297/157 X |
| 2,894,561 | 7/1959 | Mackintosh | 297/172 |
| 2,936,817 | 5/1960 | Mackintosh | 297/239 X |
| 3,100,459 | 8/1963 | Liss et al. | 297/239 X |
| 3,182,613 | 5/1965 | Hagan | 108/91 |

OTHER PUBLICATIONS

Free Standing Seatmobile Bench and Cluster, Plarisi Inc.

Master Craft Seating Co. Inc.

*Primary Examiner*—Kenneth J. Dorner
*Assistant Examiner*—Joseph Falk
*Attorney, Agent, or Firm*—Edward J. DaRin

[57] ABSTRACT

A seating frame is provided useable as a settee-cluster frame or individual settee each having an individual table top. The settee-cluster frame is of a unitary construction and is stackable, one frame on top of another. The settee-cluster frames may be arranged in a side-by-side relationship to support bench-type seating units and back rests to provide a settee seating unit providing individual seating with an individual table top.

11 Claims, 14 Drawing Figures

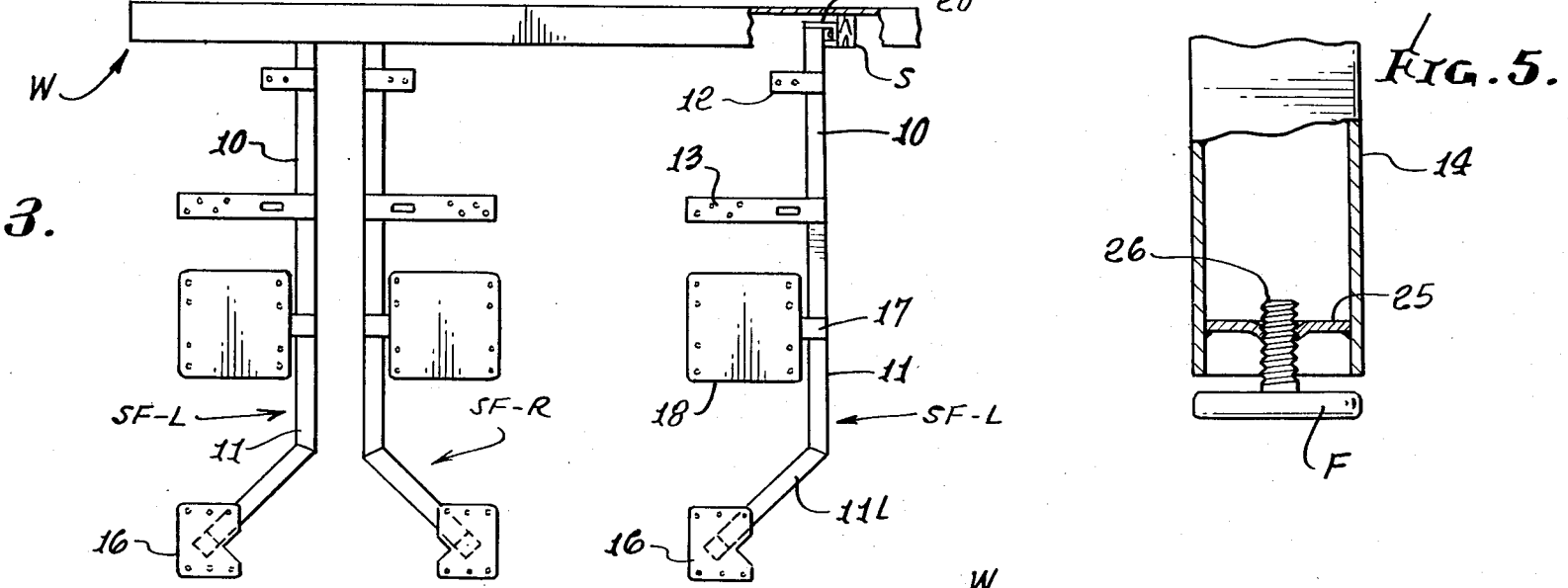
FIG. 3.
FIG. 5.
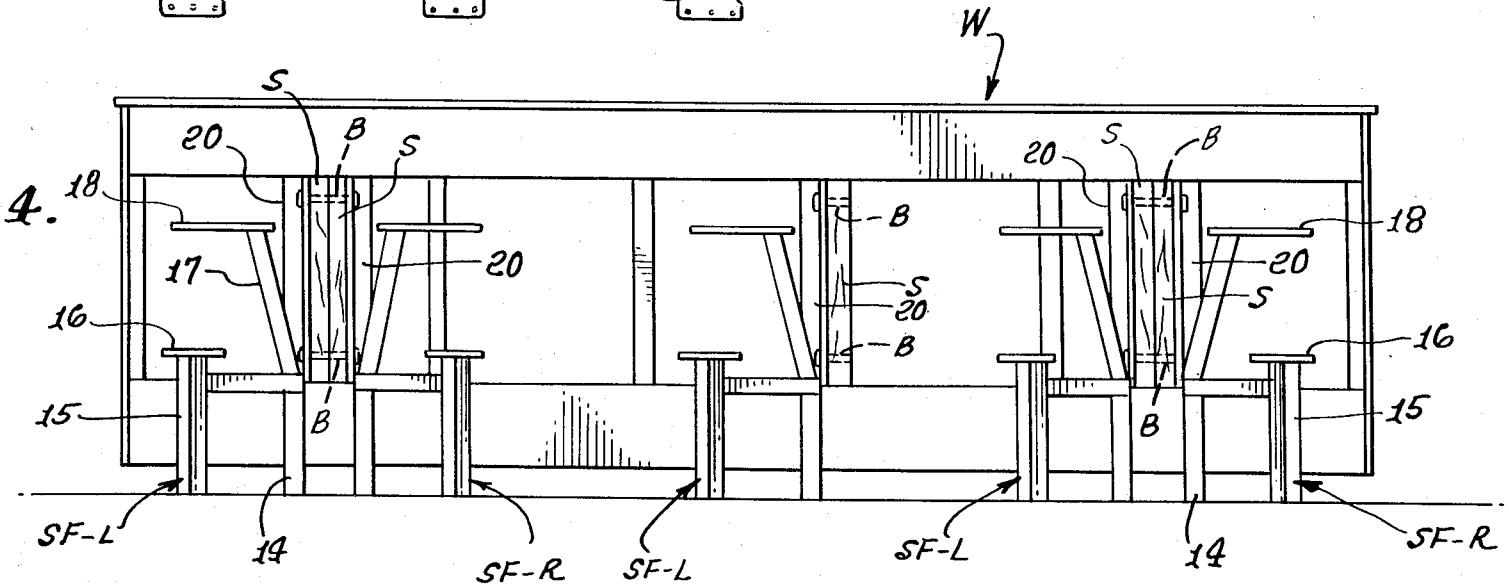
FIG. 4.

20T
20A
20L
20
20S
20A
12A
12
10
13
13A
12
20A
14
18
18A
17
11
SF
11L
16N
16
16A
15
13S
13
13D
11
12
20
12
10
BR
13
13S
18
17
7
11
IS
9
16
11L
16N
9
15
15D
16
15DF
15D
15DN
15

SETTEE SEATING UNIT AND SETTEE-CLUSTER FRAMES THEREFOR

FIELD OF INVENTION

This invention relates to seating units and, more particularly, to a settee-cluster frame and a settee seating unit for restaurants and the like.

BACKGROUND OF INVENTION

Various types of seating units are presently commercially available for use in restaurants and eating establishments of various types. Booth seating systems and individual tables are presently in use which afford the customers individual seating. Seating units in fast food outlets are usually arranged close together in an attempt to serve as many customers as possible in a given area. One type of seating unit presently in use for such fast food units comprises a bench type seating unit constructed to longitudinally extend along a wall or the like for seating a plurality of individuals. The seating frame for the bench type seating unit provides a supporting structure for individual seating units and a table top. A pair of spaced individual seating frames or a double frame are provided utilizing a common table top or a double (split) top for use by the individuals or couples seated on the opposite sides of the table top(s). In such a seating arrangement two couples, for example, may be seated individually in such a seating arrangement but they must share the same table top and/or frame whereby the couples lose a certain amount of privacy for each couple. Presently, the only frame-top configuration available to provide independent tops and seats in adjacent clusters requires the use of two, three legged frames; two multipiece frames, or one plural frame. The use of two typical three legged frames in an adjacent format clutters the floor with four closely spaced legs. The use of a plural or common frame doesn't provide the desired physical or apparent separation. In setting up the commercially available frames for the above described seating arrangement, since the frames are not of a unitary construction, they require assembly time and labor at the installation site. The assembled units have also been found to have disadvantages with respect to stability of the individual seating units and in assembling the table support structures; i.e., the individual seating units tend to tilt or splay out. Accordingly, a settee-cluster frame of improved construction is needed that permits individual couples to be seated in a cluster, and yet provide an individual table and frame for each couple, that is not shared with an adjacent customer or couple, thereby giving the desired privacy to the individual couples or an individual and a couple.

SUMMARY OF INVENTION

The present invention provides an improved, economical settee-cluster frame for use in eating establishments, such as restaurants, fast food outlets, or the like that is of a unitary construction and that can be simply installed at an installastion site without the need of assembly time and labor, and that permits individuals and couples to enjoy their food, beverages, or the like without sharing a table top with another individual or couple, and thereby maintain a certain degree of privacy at each seating unit. The settee-frame per se is advantageously defined to allow it to be simply mounted to the studs of a dividing wall or to the enclosure for the back resting structure of a bench type seating unit without any modification being required of the frame structure. The settee-cluster frame is constructed of a one-piece unit having a minimum number of elements to accommodate commercially available bench-type seating units and back rest or bolster units. The settee-cluster frames are advantageously defined to be stacked in a dense manner. The frames are defined to permit them to be stacked one on top of another without contacting one another, except at preselected points that are not visible to a customer when the frames are assembled into a complete seating unit and thereby protect the visible painted surfaces thereof. The use of the settee-cluster frames of the present invention will provide an individual with a private seating unit with another individual and privacy within a cluster of seating units. When a cluster of seating units is required, the frames can be defined for defining a left or a right hand unit of identical construction. The unitary construction of the settee-cluster frames of the present invention has the additional advantages for storage and inventory purposes and in shipping in view of the dense manner in which they can be stacked on one another without marring the painted surfaces.

The present invention provides an improved settee-cluster frame that comprises frame rail means having a preselected length for supporting a seating unit adjacent each end, and an individual table top intermediate the ends of the frame rail. Supporting legs are secured to the frame rail means adjacent each end for supporting the frame rail means in a substantially horizontal plane a preselected distance above the frame rail means supporting surface. Frame means are secured adjacent one end of the frame rail means that extends outwardly therefrom in the opposite direction from the supporting legs. The frame means is constructed and defined to be secured to mounting means for supporting the frame rail means in the desired horizontal plane. Means are also provided for supporting an individual seating unit adjacent the outside end of the frame rail means or the side opposite the mounting frame means. The supporting means is constructed and defined for supporting an individual seating unit a preselected distance above the frame rail means. The frame rail means is also constructed and defined to support a bench type seating unit at the remaining end of the frame rail means. The frame is also provided with a table top supporting means secured to the frame rail means intermediate the ends thereof in a cantilevered relationship therewith for extending a preselected distance above the frame rail means to secure an individual table top thereto, whereby a settee-cluster frame of a unitary construction is provided.

When the settee-cluster frame of the present invention is installed it is secured to a studded wall or to a vertical mounting surface without modifying the settee-cluster frame for either installation. The bench type seating structure is secured to the frame rail means along with a back resting structure or bolster positioned against the supporting wall. The unit is completed by providing the individual seating unit at one end of the frame and with the table top secured to the table top supporting means intermediate the individual seating unit and the bench top structure. The frame means may be constructed as a left or right hand unit to be mounted in a cluster or may be mounted as an individual unit for private seating.

The settee-cluster frame may include means constructed and defined to permit a plurality of similarly defined frames to be stacked one on top of another in a preselected spaced apart relationship.

BRIEF DESCRIPTION OF THE DRAWINGS

These and other features of the present invention may be more fully appreciated when considered in the light of the following specification and drawings, in which:

FIG. 3 is a top plan view, with a portion shown in section, of the installed settee-cluster frames secured to a supporting wall and before the seating units are applied thereto, as illustrated in FIG. 1;

FIG. 4 is a representation of the settee-cluster frames of the present invention as they may be secured to a dividing wall functioning as the supporting surface, as illustrated in FIGS. 1, 2, and 3;

FIG. 5 is a cross-sectional view of the mounting foot taken along the line 5—5 of FIG. 2;

DETAILED DESCRIPTION OF THE PREFERRED EMBODIMENT

Figure 1:
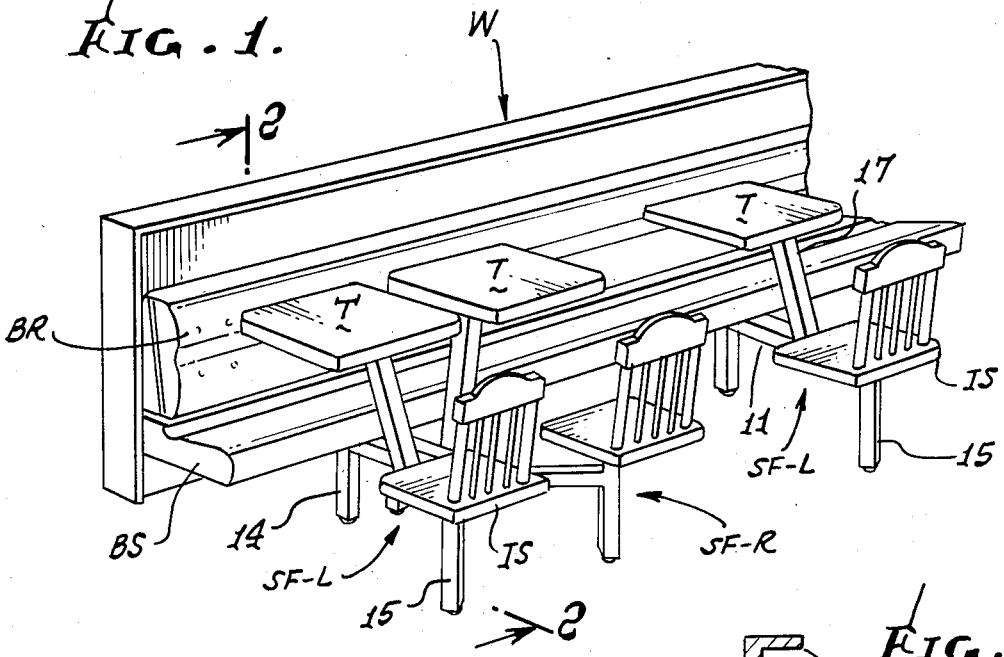
FIG. 1 is a perspective view of a seating unit utilizing the settee-cluster frames embodying the present invention. The settee-cluster frames are shown arranged in a cluster and as an individual unit mounted to a dividing wall supporting structure.
Figure 2A:
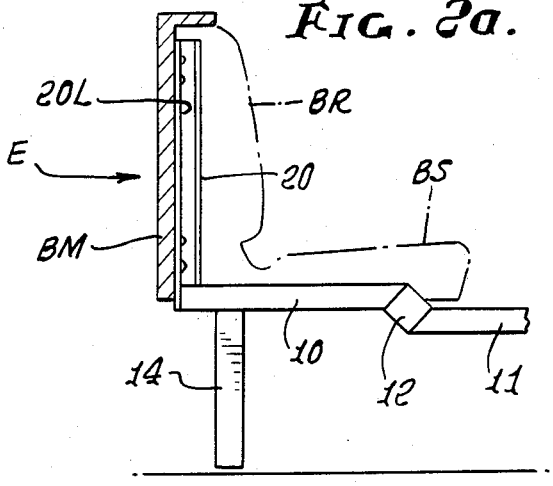
FIG. 2*a* is a partial view of the bench-bolster seating unit secured to a seating unit enclosure.
Figure 2:
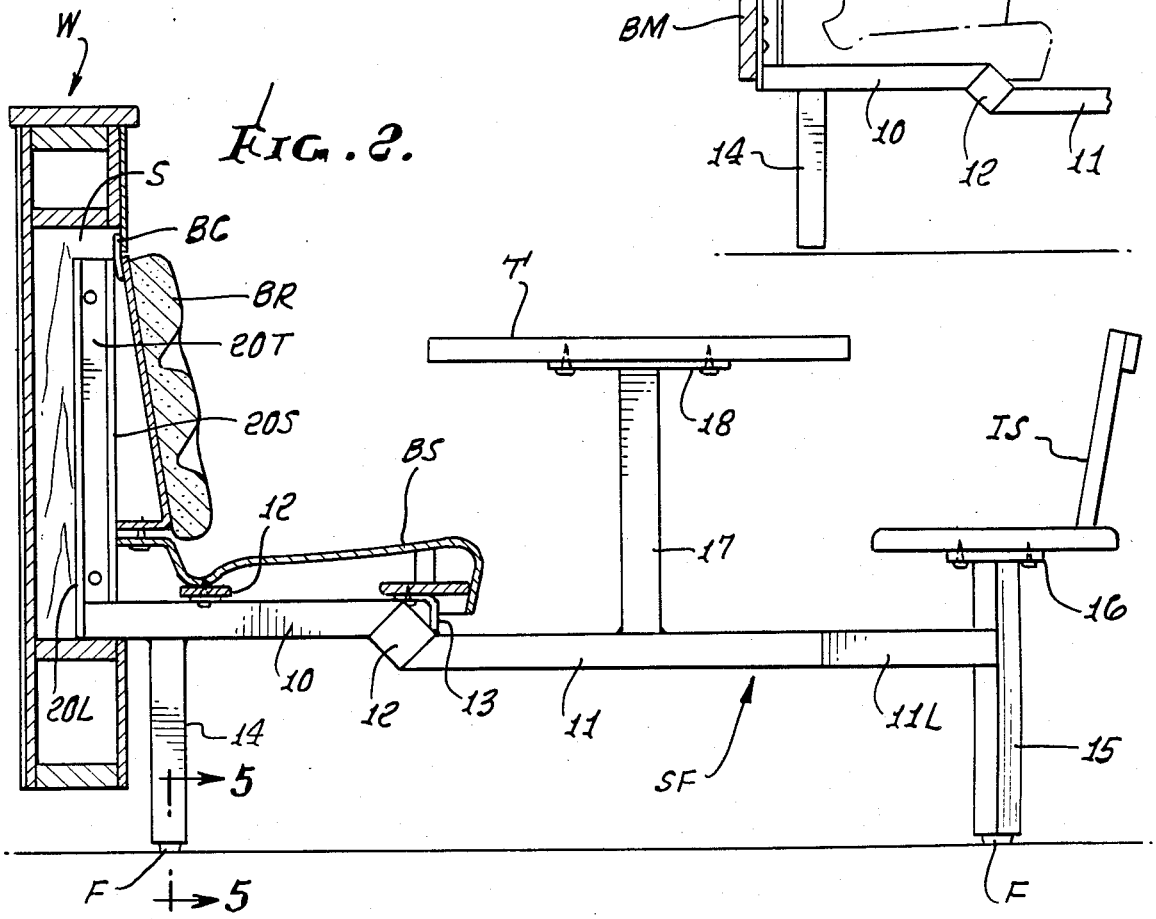
FIG. 2 is a cross-sectional view taken along the line 2—2 of FIG. 1 and illustrating portions in elevation.

Now referring to the drawings, the improved settee-cluster frame SF will be described in detail. The settee-cluster frames SF are illustrated in FIG. 1 as the frames may be assembled as a settee-cluster having a left-hand frame SF-L, and a right-hand frame SF-R, arranged side by side in a cluster as two individual seating units, and an individual seating unit spaced therefrom and illustrated as a left-hand settee-cluster frame SF-L. The settee-cluster frames SF are secured to a dividing wall W provided in the restaurant, eating establishment, etc. In FIG. 4 the complete wall W (of FIG. 1) is illustrated and mounts a further cluster of left and right-hand settee-cluster frames SF to the right of the individual seating unit, shown as a left-hand frame in FIGS. 1 and 4. The completed seating units are illustrated in FIGS. 1 and 2 as supporting individual seating unit IS at one end thereof, and a base or bench type seating unit BS at the opposite end of the frame along with a bolster or back rest BR. A table top T is secured intermediate the seating units IS and BS. Each of the seating units illustrated in FIGS. 1 and 2 are secured to a mounting means in the same fashion whether they are left or right-hand units. The dividing wall W is illustrated in FIGS. 1, 2, and 4 as having studs S to which the frames SF are secured, while the enclosure E of FIG. 2*a* is defined to merely enclose and finish off the bench type seating unit BS, the bolster BR, and the frame SF by the enclosure in any conventional fashion. The alternate arrangements for securing the frames F will be explained more fully hereinafter.

Figures 6, 7, 8, 9:
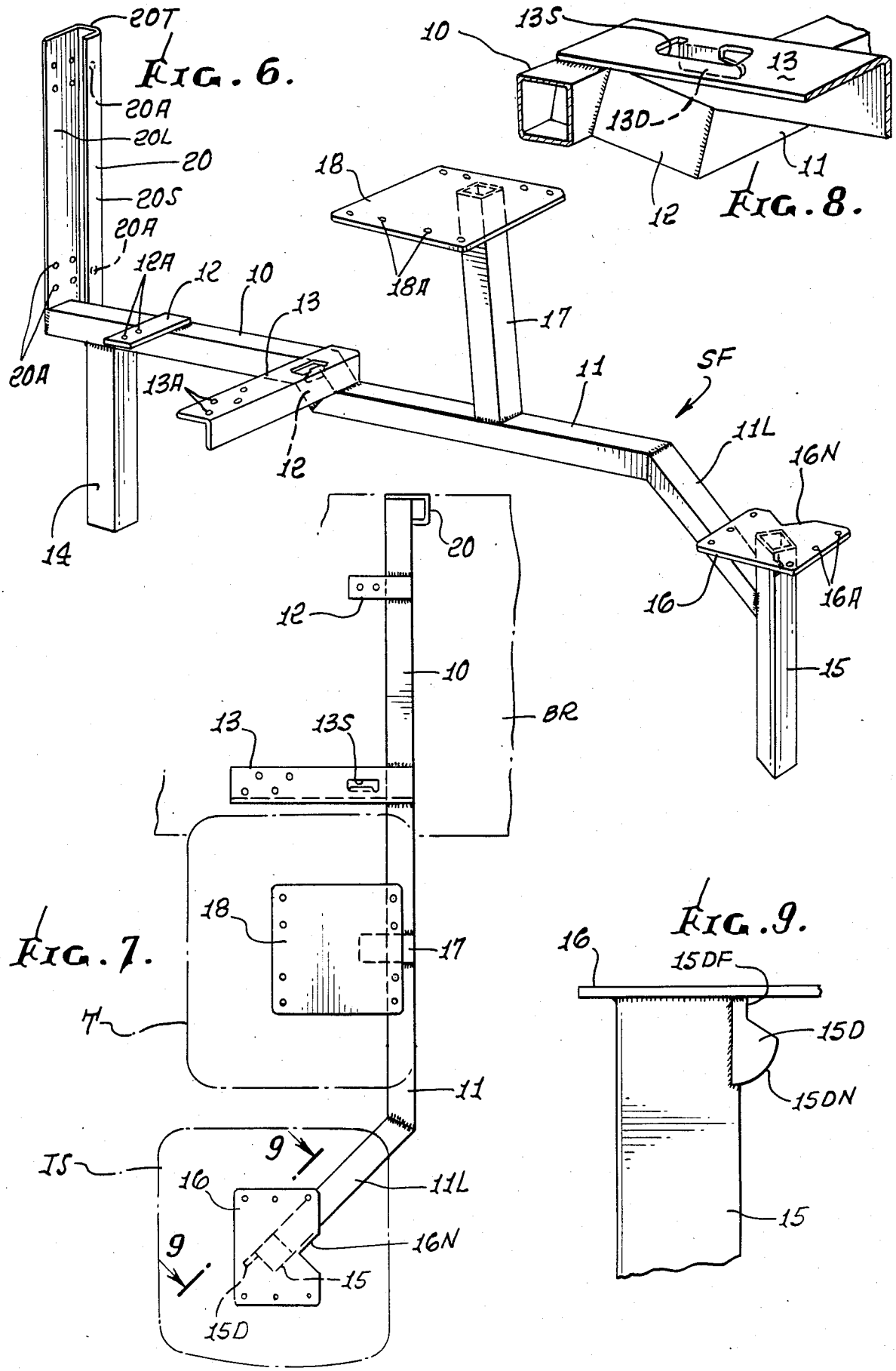
FIG. 6 is a perspective view of a detached settee-cluster frame of the present invention.
FIG. 7 is a top plan view of the frame of FIG. 6 showing the seating unit and the table top in dotted outline, along with the bench-type seating unit.
FIG. 8 is a partial perspective view of the bench-type seating unit supporting element and showing the stacking element defined thereon.
FIG. 9 is a cross-sectional view, taken along the line 9—9 of FIG. 7, illustrating the stacking element for the supporting leg.

The details of the settee-cluster frame SF will now be examined in conjunction with the illustrated freestanding settee-cluster frame SF of FIG. 6, in particular. The principle elements of the settee-cluster frame SF are constructed of steel tubular elements, along with flat plates of conventional steel structural members, all welded together to form a unitary settee-cluster frame SF. The term tubular as employed herein, comprehends the commercially available forms of tubular elements that have either a circular or quadrilateral cross section. The quadrilateral cross sections may either be of a square cross section or of a rectangular cross section. In the preferred embodiment illustrated in the drawings, a square tubular construction is illustrated. The frame rail SF comprises a first rail section 10 secured to a rail section 11 by welding. The two sections 10 and 11 are secured together in two spaced parallel horizontal planes by means of a transition member 12. The transition member 12 is a piece of square tubing that is rotated on end and secured at one open end to the rail section 10 at the open end thereof, and to the open end of the rail section 11 at an opposite face thereof, as can be best appreciated by examining FIGS. 2 and 8. The rail section 11 has welded thereto another tubular section 11L which is secured thereto at a preselected acute angle to the longitudinal center line of the tubular section 11. As illustrated in the drawings, the acute angle is a 45 degree angle, which is oriented to the left of the longitudinal center line of the tubular element 11 to define a left-hand frame unit. A right-hand frame unit is defined by having the tubular section 11L oriented to the right of the longitudinal center line of the element 11 at the same acute angle.

Figure 13:
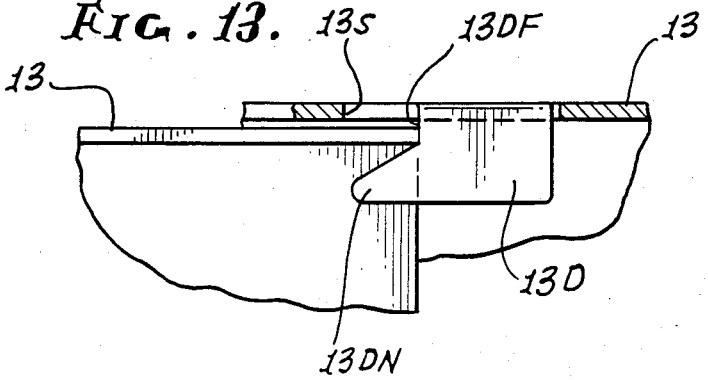
FIG. 13 is a partial, cross-sectional view taken along the line 13—13 of FIG. 10 showing the stacking elements in a stacked relationship at the bench seating unit supporting brackets.

The first rail section 10 is secured to bench mounting elements 12 and 13. The bench mounting element 12 is secured or welded to the top side of the element 10 a preselected distance from the left-hand end of the element 10, as illustrated in FIG. 6. Adjacent the free end of the plate 12 there is provided a pair of fastening apertures 12A for securing the bench type seat BS. An L-shaped structural element is secured to the right-hand end of the rail section 10 and is identified as the element 13. The L-shaped element 13 is welded to the right-hand end of the element 10 with one arm of the L dependent therefrom and engaging the right-hand corner of the transition element 12. The free end of the element 13 is provided with a plurality of spaced fastening apertures 13A for securing the bench type seating unit BS, as will be appreciated from examining FIG. 2. The element 13 is provided with an opening 13S that has a stacking element 13D dependent therefrom and constructed of the steel material of the element 13 and integrally therewith. The stacking element 13D is of a generally rectangular construction with its outer end having a nose 13DN terminating at a vertical flat portion 13DF; see FIG. 13. The frame SF is provided with supporting legs 14 and 15 for supporting the thus defined rail in a preselected horizontal plane above the supporting surface for the frame SF. The inner leg, or the leg shown on the left-hand side of FIG. 6, is of tubular construction and is welded to the rail section 10, at a preselected distance spaced from the left-hand end of the element 10, as illustrated. The supporting leg 14 is welded below the element 10, in a transverse relationship with the element 10. The outer supporting leg, or the right-hand leg 15, is secured to the open end of the rail section 11L and is welded transverse to the end of the element 11L. The leg 15 is also of the square tubular construction and forms a right angle with the end of the element 11L. The supporting leg 15 is defined to extend a preselected distance above the top surface of the element 11L for supporting a seating unit. The supporting leg element 15 has a supporting plate 16 for securing an individual seating unit thereto. For this purpose, the seating supporting plate 16 is provided with a plurality of securing apertures 16A arranged adjacent the opposite longitudinal edges thereof. The plate 16 is welded to the top end of supporting leg 15. The plate 16 is arranged in a plane transverse to the plane of the top end of supporting leg 15, but is rotated by approximately an angle of 45 degrees therewith.

The seat supporting plates 16 and the legs 15 are each defined to permit additional frames SF to be stacked thereto, one on top of another. For this purpose, the seating supporting plate 16 is provided with an off center stacking notch 16N arranged along one edge thereof. The notch 16N is illustrated in FIG. 6 along the right-hand edge thereof and is spaced to the left of the center line of the plate for stacking purposes. The notch 16N is illustrated as a V-shaped notch having a 90 degree internal angle. It should be noted, however, that any other suitable configuration for the notch may be utilized, including a square notch in accordance with the present invention. The provision of the V-notch 16N for the supporting plate 16 and arranging it at a 45 degree angle with the supporting leg 15 rather than at 90 degrees minimizes the loss of strength to the plate 16. The notch 16N is displaced from the center of the supporting plate to cause a longitudinal displacement of a pair of stacked frames SF to allow them to stack at element 13; i.e., one L-shaped element 13 is slidably received within another L-shaped element 13. Coacting with the notch 16N for stacking purposes, there is provided on the supporting legs 15 a stacking dog 15D. The stacking dog 15D is secured to the outside corner of the square supporting leg 15 and is best appreciated from examining FIG. 9. The stacking dog 15D is secured or welded to the corner of the supporting leg 15 immediately below the seat supporting plate 16 on the opposite side from the stacking notch 16N. The stacking dog 15D, as the dog 13D for the element 13, is provided with a flat surface 15DF and a noselike surface 15DN. The coaction of the stacking notch 16 and the stacking dog 15D can be best appreciated from examining FIG. 11 wherein the corner of the V-notch engages the flat 15DF with the adjacent edge of the notch lying adjacent the leg 15 and the opposite edge of the notch being displaced from the leg, as illustrated. It should be noted that the stacking dog 15D is secured to the corner of the supporting leg 15 so that the surface 15DF extends outwardly from the corner of the leg and, therefore, a leg 15 stacked thereto is offset or vertically spaced from the corner so that the engagement of the stacking notch 16N therewith does not place the two legs 15 in engagement with one another to mar any painted surface. With the offset relationship of the notch 16N there is also an offset in a longitudinal direction to permit the elements 13 to stack. The only points of contact between stacked frames SF, then, are below the seating surfaces and any marring of paint that results therefrom will not normally be visible to a customer.

The frame rail includes an upstanding tubular element 17 secured to the second rail section 11 intermediate its ends. The element 17 is considered as a table supporting element, or leg, and is welded to the element 11 at a preselected acute angle with respect to the line that is transverse to the longitudinal center line of the element 11. Stated differently, the element 17 forms a slight angle that is tilted from the vertical, to the left side, of the longitudinal center line of the element 11. The table supporting leg 17 is secured thereto by welding. The table supporting plate 18 is not secured at its center, as in the conventional manner, but is offset, for stacking purposes, so that it is secured adjacent the outer edge thereof, or the right-hand edge, as illustrated in FIG. 6. The supporting plate 18 has a plurality of spaced apart securing apertures 18A defined thereon along two longitudinal edges, as illustrated in FIG. 6, for securing a table top T thereto.

The remaining element for the frame rail is the means for securing the frame SF to a supporting surface or a dividing wall F. As illustrated in FIG. 6, this means is the J-shaped element 20 that is welded to the open end of the first rail section 10. The J-shaped element 20 consists of three arms in which the long or normally vertical arm of the "J" is identified as the arm 20L and the transverse arm or the shorter arm 20T. The short arm that is parallel to the arm 20L and transverse to the arm 20T is identified as the arm 20S. The element 20 is welded to the end of the element 10 at the long arm 20L and also adjacent to the short arm 20S whereby the transverse arm 20T is spaced from the side of the element 10. When the element 20 is welded to the element 10 in this manner, it boxes off the open end of the tubular element 10, and as a result of this construction transfers any torque developed in the frame SF to the upright fastening member. In order to secure the element 20 to a dividing wall W, or to a backing member BM, the legs 20L and 20T are provided with predrilled mounting apertures. The arm 20L has eight such apertures 20A arranged at opposite ends in groups of two for securing to the backing member BM, as illustrated in FIG. 2*a*. The arm 20T for the element 20 has a pair of securing apertures 20A arranged in a spaced apart relationship intermediate the ends of the leg 20T for accepting bolts that are secured through predrilled holes of the studs S, as illustrated in FIG. 2 in particular.

The legs 14 and 15 are each provided with an adjustable mounting foot F secured to the supporting end of the legs 14 and 15. The mounting foot F for the supporting leg 14 is shown in detail in FIG. 5. As illustrated, the supporting leg 14 includes a plate 25 which is welded to the inside of the leg 14 a preselected distance inwardly of the supporting end thereof. The plate 25 is shaped and threaded to receive a fastener 26 secured to one side of the foot F. The foot F can then be threaded in and out of the plate 25 to adjust the height of the leg to take care of any irregularities in the supporting surface.

Figure 10:
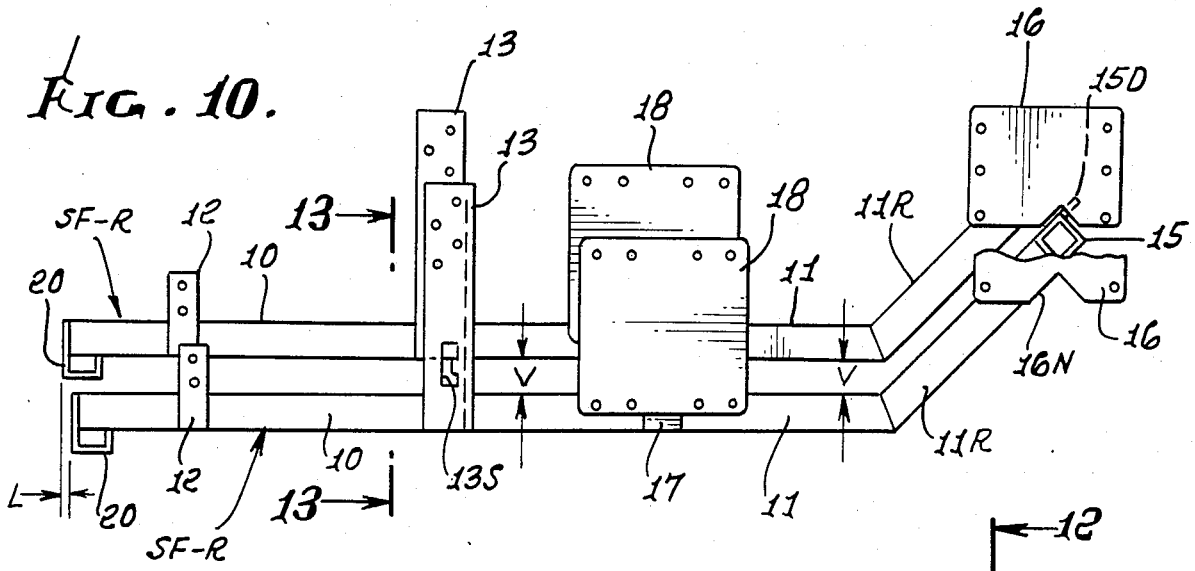
FIG. 10 is an elevational view of a pair of settee-cluster frames embodying the present invention illustrated in a spaced apart stacked relationship one above the other.
Figure 12:
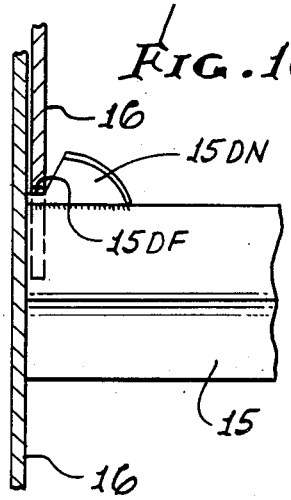
FIG. 12 is a cross-sectional view taken along the line 12—12 of FIG. 11.
Figure 11:
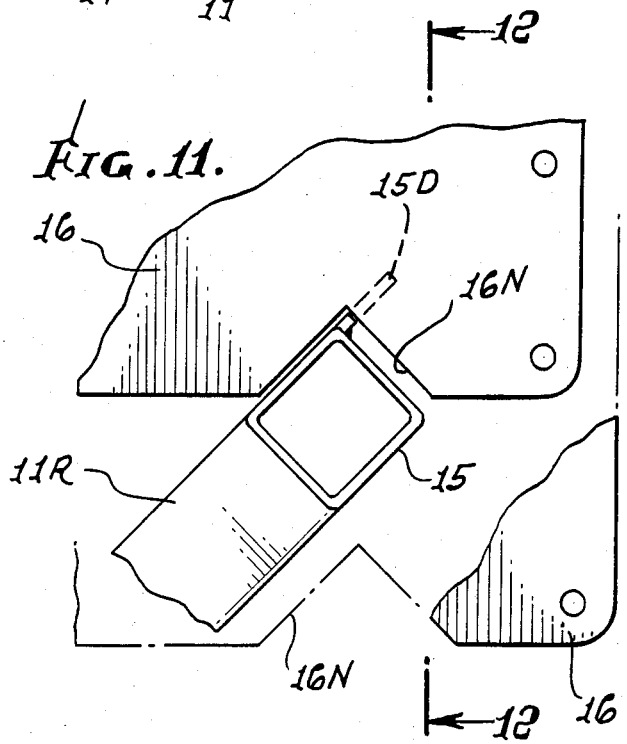
FIG. 11 is a partial, enlarged, top plan view of the stacked arrangement of a pair of frame units, as illustrated in FIG. 10, as they are interengaged at the stacking element for the supporting leg.

Now referring to FIG. 10, the manner of stacking a plurality of frames SF will be described with the above construction for the stacking means in mind. In the illustration of FIG. 10 a pair of frames SF are illustrated stacked one on top of another. It should be noted at this point that the pair of frames illustrated in FIG. 10 are a pair of right hand frames and are therefore identified in the drawing as frames SF-R. As viewed in the drawing, the bottom frame SF is initially positioned on the ground or supporting surface. The bottom frame SF-R is positioned on the supporting surface with the elements 12 and 13 positioned transverse to the supporting surface. The element 20 and the rail sections 10 and 11 will lie on the supporting surface. The table supporting leg 17 and table supporting plate 18 will be inclined above the supporting surface in accordance with the angle provided for the supporting leg 17 relative to the frame section 11 as described hereinabove. The rail section 11R with the seat supporting plate 16 will extend upwardly from the supporting surface at the acute angle selected for the rail section 11R, illustrated as a 45 degree angle. The second frame SF-R is then positioned on top of the bottom frame SF-R as illustrated. In stacking, the topmost seating supporting plate 16 is positioned with the stacking notch 16N facing the stacking element 15D for the bottom frame SF-R. The stacking notch 16N is moved to position the apex of the V-notch 16N to engage the flat portion 15DF of the stacking element 15D. This places the left hand surface of the V stacking notch 16N in parallel alignment with the adjacent surface of the supporting leg 15 and the right hand surface of the notch 16N spaced from the adjacent surface of the supporting leg 15, as best illustrated in FIGS. 11 and 12. This latter spacing results from the fact that the stacking element 15D extends outwardly from the corner of the supporting leg 15 and the spacing is defined by the distance the element 15DF extends outwardly from the corner of the supporting leg 15 (see FIG. 9). The nose portion 15DN of element 15D secures the two frames together for stacked purposes. In recalling that the stacking notch 16N is defined along the edge of the seat supporting plate 16, this offset relationship is defined to displace the top frame SF-R slightly to the left longitudinally of the bottom frame SF-R. This displacement is sufficient to displace the L-shaped element 13 for the top frame SF-R relative to the bottom frame SF-R to permit the topmost L-shaped element 13 to slide within the bottom element 13. These two elements 13 are stacked until the bottom edge of the topmost element 13 engages the flat surface 13DF for the stacking element 13D and comes to rest. The nose-like portion of the stacking element 13D prevents the stacked elements 13 from becoming readily disengaged; locks them together for stacking purposes as is the case for the nose portion 15DN for the stacking element 15D; see FIG. 13. With this stacked relationship of the two frames SF-R, the elements 12 and 20 will be stacked alongside of one another in a vertically spaced apart relationship and longitudinally displaced to the left as viewed in FIG. 10. The table supporting plates 18 in this relationship will be stacked so that the bottom edge of the plate 18 for the top frame SF-R will be arranged a very short distance above the element 17 for the bottom frame SF-R. The two plates 18 will be slidably engaged to have a stacked position whereby the top surface of the plate for the top frame SF-R will engage the bottom surface for the plate 18 for the bottom frame SF-R, but longitudinally and vertically displaced as illustrated. In this relationship, the table top supporting elements 17 and 18 are vertically spaced apart and longitudinally displaced to the left as viewed in FIG. 10. In viewing the stacked relationship of the frames SF-R in FIG. 10, it will be noted that the vertical spacing between the frames is denoted as the space "V". The longitudinal displacement of the frames SF-R is denoted on the left hand end of the frames as the distance "L". In the same manner, additional frames SF-R can be stacked onto the top frame SF-R for stacking a multiplicity of the frames SF-R.

In the above described stacking relationship, along with viewing FIG. 10, it should be appreciated that when the frames SF-R are painted that the only points of contact between the stacked frames is at points that are underneath the frames when installed into seating units and as a result any marring, scratching or the like of the painted surfaces that results from the stacking operations will not be visible. To further protect the painted surfaces, certain of the portions of the frames SF that are clearly visible in the completed seating unit can be wrapped with a protective wrapping such as corrugated paper. In this case, the elements 14, 15, 17, and 11L can be wrapped over their major surface along with the portion of the rail section 11 to the right of element 17, as illustrated in FIG. 10. The stacked frames SF-R are now ready for shipment, placed in inventory, or the like. Upon receiving the stacked frames SF at the installation site they are readily unstacked without marring the painted surfaces.

At the installation site for the frames SF the frames are installed without any assembly steps being required as to the frames SF per se due to their unitary construction as previously described. The manner of mounting the frames SF at the installation site is basically the same except for the type of dividing wall or enclosure required or desired by the proprietor of the eating establishment. When a dividing wall W of the type illustrated in FIG. 2 is desired, the construction of the wall W includes studs S therein. The mounting element 20 is secured to the studs at the surface 20T through the pair of spaced fastening apertures arranged adjacent opposite ends; see FIG. 2. The studs S are provided with pre-drilled holes to locate the element 20. When a cluster of frames SF-L and SF-R are desired, the wall W is provided with a pair of studs S arranged side by side with the mounting apertures arranged in axial alignment. A single mounting bolt and fastener can then secure a pair of frames SF-L and SF-R at each mounting aperture. The mounting bolt B is passed through one of the apertures on the surface 20T and through the pre-drilled holes for the pair of studs S and through the aperture for the other frame SF. The bolt B is then secured with a suitable fastener to mount and secure the frames SF-L and SF-R to the pair of studs S. The same steps are performed for the other aperture for the surface 20T and pre-drilled holes; see FIG. 4. The same procedure is followed when the wall W is constructed and defined to provide an individual settee alongside the cluster, as illustrated in FIGS. 1, 3, and 4. In this instance, the bolt B need only be one-half of the length of the bolts B for the settee-cluster arrangement described; see FIGS. 3 and 4. With the wall W illustrated in the drawings, the supporting legs 14 and 15 for the frames SF will support the walls W above the supporting surface, as illustrated in FIGS. 1, 2, and 4. The remaining portion of the wall W is constructed and defined in any conventional fashion to enclose the wall and secure the bench-type seating unit BS and the bolster or back rest BR as will be described hereinafter.

If a dividing wall W of the above-described construction is not desired but merely an enclosure E to finish off the seating unit to enclose the seating units BR and BS, an enclosure E of the type illustrated in FIG. 2*a* can be provided. In this arrangement, the mounting element or J-shaped element 20 is secured to a backing member BM. The backing member BM extends the complete length of the seating arrangement, whatever is required. In this arrangement, the J element 20 is secured by means of the eight securing apertures provided on the surface 20L for the element. Suitable fasteners are secured through the securing apertures of the surface 20L into the backside of the member BM, as illustrated in FIG. 2*a*.

Whatever the mounting surface that has been provided, once the frames SF are secured in position they are aligned to extend at a perpendicular angle to the mounting surface to complete the assembly of the seating unit. The bench-type seating unit BS can then be installed. The bench-type seating unit BS and the bolster or back rest BR are of commercially available construction. The seating unit BS is mounted on all of the frames SF defining the overall seating arrangement to span the frames from one end to the opposite end, as illustrated in the drawings. The seating unit BS is supported on the rail sections 10 of each frame SF and extend outwardly therefrom in accordance with the selected length for the wall W or enclosure E; see FIG. 1, for example. The seating unit is then pushed back between the ends of the wall W or enclosure E until the back edge engages the edge of the mounting element 20 at the surfaces 20S. The seating unit BS can then be secured to the frames SF by securing them to the apertures 12A and 13A for the supporting elements 12 and 13, respectively, by suitable fasteners or screws, as illustrated in FIG. 2. For the purpose of installing the bolster or back rest BR, the wall W or enclosure E is provided with a bolster clip BC for securing the bolster BR thereto. The bolster BR is mounted over the seating unit BS and extends thereover the same distance or length as the unit BS. The bolster BR is installed by engaging metal clips (not shown) conventionally provided at the top of element BR with the metal brackets BC. The element BR is moved over the base BS until it engages the mounting element 20 at the surface 20S. The element BR is then secured to the seating unit BS through the underside of the unit BS with suitable fasteners or screws BF, as illustrated in FIG. 2.

With the seating element BS and back rest or bolster BR assembled on the frames SF, the assembly of the frames is completed by securing the individual seating units IS and table tops 18 to the frames SF. The individual seating units IS are best illustrated in FIG. 1 as comprising a wooden seat with a wooden back rest secured thereto of a conventional construction. The seating units IS are secured to the frames SF at the seat supporting plates 16 therefor by means of suitable fasteners or screws secured from the back side of the plates 16 through the apertures 16A into the back of the wooden seats for the elements IS; see FIG. 2. Similarly, the table tops T are secured to each frame SF by means of the plates 18. Suitable fasteners or screws are secured through the apertures 18A of the plates 18 to the back side of the table tops T. The resulting seating unit for a dividing wall W is illustrated in FIG. 1.

I claim:

1. A settee-cluster frame constructed as a unitary structure capable of being used with at least another similarly defined settee-cluster frame arranged adjacent thereto in a spaced longitudinal alignment, said arrangement capable of use with a bench type seating unit longitudinally extending between the thus arranged frames, comprising frame rail means having a preselected length for supporting a seating unit adjacent each end and an individual table top intermediate the ends of the frame rails means, supporting legs secured to the frame rail means adjacent each end for supporting the frame rail means in a substantially horizontal plane a preselected distance above the frame rail means supporting surface, frame means secured adjacent one end of the frame rail means and extending outwardly therefrom in the opposite direction from the supporting legs, said frame means being constructed and defined to be securable to an upstanding mounting structure for supporting the frame rail means in said horizontal plane, means secured to the supporting leg spaced from said frame means for supporting an individual seating unit adjacent the opposite end of the frame rail means from said frame means, said supporting means is constructed and defined for supporting an individual seating unit a preselected distance above the frame rail means, wherein the individual seating unit comprises a seating unit plate means secured to the second supporting leg element, said frame rail means is constructed and defined to support a portion of said longitudinally extending bench-type seating unit at said end of the frame rail means adjacent said frame means, said frame including means constructed and defined to permit a plurality of the thus defined frames to be densely stacked together in a preselected spaced apart relationship, said seating unit plate means comprises a single plate secured to the second supporting leg element, said single plate having a preselected V-notch defined along one edge thereof adjacent to but offset on one side of the center of said one edge, said single plate is secured to the second supporting leg in a plane substantially transverse to the end of said leg and defining a preselected acute angle relative to said leg and oriented so that said V-notch has one leg thereof substantially parallel to the side of the second rail tubular section extending at said acute angle but spaced a preselected distance on the outside of said side of said second tubular section, a stacking element secured to the second supporting leg adjacent the end securing said single plate and below the single plate and extending outwardly therefrom a preselected distance to permit another similarly defined settee-cluster frame to be stacked therewith by engaging the V-notch of the single plate of said another frame at the stacking element to permit them to be stacked in a spaced apart relationship in accordance with said preselected distance, and table top supporting means secured to the frame rail means intermediate the ends thereof in a cantilevered relationship therewith for extending a preselected distance above the frame rail means to secure an individual table top thereto whereby a settee-cluster frame of a unitary construction is provided, said table supporting plate means is secured to the table supporting tubular element adjacent an edge of the plate means intermediate the ends of said edge of the plate means to thereby extend in the same direction as the table supporting element.

2. A settee-cluster frame as defined in claim 1 wherein said frame rail means, supporting legs and table top securing means are constructed and defined of tubular elements.

3. A settee-cluster frame as defined in claim 2, wherein said tubular elements have a square cross-sectional tubular configuration.

4. A settee-cluster frame comprising a frame rail of unitary construction comprising a first rail tubular section having a preselected length for supporting a bench-type seating unit thereon, said first rail section including means secured thereto and extending outwardly therefrom in a substantially transverse direction from the first rail section for receiving and securing a bench-type seating unit thereon in conjunction with the first rail section, a second rail tubular section having a straight portion with one end thereof extending at a preselected acute angle with respect to the longitudinal center line of the straight portion of the second tubular section, means for securing the remaining end of the second rail tubular section to the first rail tubular section adjacent one end thereof and in a horizontal plane spaced a preselected distance below the horizontal plane of the first rail tubular section, a first supporting leg tubular element secured adjacent the opposite end of the first tubular section from the second rail tubular section for supporting the first tubular section in a preselected horizontal plane a preselected distance above the supporting surface therefor, a second supporting leg tubular element secured to said one end of the second tubular section intermediate the ends thereof for supporting the second tubular section a preselected distance above the supporting surface therefor in a horizontal plane parallel to the horizontal plane of the first tubular section but spaced a preselected distance below same, plate means secured to the end of the second supporting leg element extending above the horizontal plane of the second rail section and constructed and defined for supporting and securing an individual seating unit thereon, a table supporting tubular element secured at one end to the second rail tubular section intermediate the ends of the straight portion of the second rail tubular section and extending outwardly thereof at a preselected acute angle above the horizontal plane of the second rail tubular section, the table supporting means and the acute angle for said end of the second rail tubular section extending to the same side of the longitudinal centerline of the straight portion of the second rail tubular section, plate means secured to the remaining end of the table supporting tubular element for supporting and securing a table top individual to the seating units mounted to the settee-cluster frame, said table supporting plate means is secured to the table supporting tubular element adjacent an edge of the plate means intermediate the ends of said edge of the plate means to thereby extend in the same direction as the table supporting element, said seating unit plate means comprises a single plate secured to the second supporting leg element, said single plate having a preselected V-notch defined along one edge thereof adjacent to but offset on one side of the center of said one edge, said single plate is secured to the second supporting leg in a plane substantially transverse to the end of said leg and defining a preselected acute angle relative to said leg and oriented so that said V-notch has one leg thereof substantially parallel to the side of the second rail tubular section extending at said acute angle but spaced a preselected distance on the outside of said side of said second tubular section, a stacking element secured to the second supporting leg adjacent the end securing said single plate and below the single plate and extending outwardly therefrom a preselected distance to permit another similarly defined settee-cluster frame to be stacked therewith by engaging the V-notch of the single plate of said another frame at the stacking element to permit them to be stacked in a spaced apart relationship in accordance with said preselected distance, and means secured to the end of the first rail tubular section and extending outwardly therefrom in a direction opposite to the first supporting leg tubular element that is constructed and defined to permit the thus defined settee-cluster frame to be securable to a substantially vertically extending mounting structure to maintain the frame in said horizontal relationships.

5. A settee-cluster frame as defined in claim 4, wherein said means secured to said first rail section for receiving and securing a bench seating unit comprises an L-shaped element having a stacking element extending outwardly from one of the legs of the L-shaped element a preselected distance to engage the similarly defined L-shaped element of another similarly defined settee-cluster frame when stacked thereto by placing said L-shaped element in a stacked spaced apart relationship in accordance with said preselected distance.

6. A settee-cluster frame as defined in claim 4, wherein said second supporting leg has a square cross-sectional tubular configuration and said second rail tubular section has a square cross-sectional configuration and is secured in a transverse plane to the plane of said second supporting leg, said stacking element is secured to the corner of the supporting leg substantially diagonally spaced from said V-notch.

7. A settee-cluster frame as defined in claim 6, wherein said V-notch is approximately 90 degrees.

8. A settee-cluster frame comprising a frame rail of unitary construction comprising a first rail tubular section having a preselected length for supporting a bench-type seating unit thereon, said first rail section including means secured thereto and extending outwardly therefrom in a substantially transverse direction from the first rail section for receiving and securing a bench-type seating unit thereon in conjunction with the first rail section, a second rail tubular section having a straight portion with one end thereof extending at a preselected acute angle with respect to the longitudinal center line of the straight portion of the second tubular section, means for securing the remaining end of the second rail tubular section to the first rail tubular section adjacent one end thereof and in a horizontal plane spaced a preselected distance below the horizontal plane of the first rail tubular section, a first supporting leg tubular element secured adjacent the opposite end of the first tubular section from the second rail tubular section for supporting the first tubular section in a preselected horizontal plane a preselected distance above the supporting surface therefor, a second supporting leg tubular element secured to said one end of the second tubular section intermediate the ends thereof for supporting the second tubular section a preselected distance above the supporting surface therefor in a horizontal plane parallel to the horizontal plane of the first tubular section but spaced a preselected distance below same, said second supporting leg including stacking means for receiving the seating unit plate means of a similarly defined settee-cluster frame in a stacked relationship but longitudinally displaced, said seating unit plate means is constructed and defined to be received at said stacking means when stacked thereto, and wherein said means secured to said first rail section for receiving and securing a bench seating unit includes stacking means for receiving the same means of a similarly defined settee-cluster frame in said stacked and displaced relationship, plate means secured to the end of the second supporting leg element extending above the horizontal plane of the second rail section and constructed and defined for supporting and securing an individual seating unit thereon, said seating unit plate means comprises a single plate secured to the second supporting leg element, said single plate having a preselected V-notch defined along one edge thereof adjacent to but offset on one side of the center of said one edge, said single plate is secured to the second supporting leg in a plane substantially transverse to the end of said leg and defining a preselected acute angle relative to said leg and oriented so that said V-notch has one leg thereof substantially parallel to the side of the second rail tubular section extending at said acute angle but spaced a preselected distance on the outside of said side of said second tubular section, a stacking element secured to the second supporting leg adjacent the end securing said single plate and below the single plate and extending outwardly therefrom a preselected distance to permit another similarly defined settee-cluster frame to be stacked therewith by engaging the V-notch of the single plate of said another frame at the stacking element to permit them to be stacked in a spaced apart relationship in accordance with said preselected distance, a table supporting tubular element secured at one end to the second rail tubular section intermediate the ends of the straight portion of the second rail tubular section and extending outwardly thereof at a preselected acute angle above the horizontal plane of the second rail tubular section, the table supporting means and the acute angle for said end of the second rail tubular section extending to the same side of the longitudinal centerline of the straight portion of the second rail tubular section, plate means secured to the remaining end of the table supporting tubular element for supporting and securing a table top individual to the seating units mounted to the settee-cluster frame, said table supporting plate means is secured to the table supporting tubular element adjacent an edge of the plate means intermediate the ends of said edge of the plate means to thereby extend in the same direction as the table supporting element, and means secured to the end of the first rail tubular section and extending outwardly therefrom in a direction opposite to the first supporting leg tubular element that is constructed and defined to permit the thus defined settee-cluster frame to be securable to a substantially vertically extending mounting structure to maintain the frame in said horizontal relationship.

9. A seating frame of unitary construction comprising horizontal frame rail means having a preselected length for supporting a seating unit adjacent an end thereof, said frame rail means comprising first frame rail means having a straight longitudinally extending portion and second frame rail means secured to an end of said first rail means extending at a preselected acute angle with respect to the longitudinal center line of said first rail means, a supporting leg secured to the second frame rail means adjacent the end of said second rail means for supporting the second frame rail means in a substantially horizontal plane a preselected distance above the second frame rail means supporting surface, frame means secured adjacent the opposite end of the first frame rail means from said second rail means and extending outwardly therefrom in the opposite direction from the supporting leg for said second frame rail means to be securable to an upstanding mounting structure for supporting the frame rail means in said horizontal plane, and plate means secured to said supporting leg for supporting an individual seating unit a preselected distance above the supporting surface, said plate means comprises a single plate having a preselected V-notch defined along one edge thereof adjacent to but offset on one side of the center of said one edge, said single plate is secured to the supporting leg in a plane substantially transverse to the end of said leg and defining a preselected acute angle relative to said leg and oriented so that said V-notch has one leg thereof substantially parallel to the side of the second frame rail means but spaced a preselected distance on the outside of said side of said second frame rail means, and a stacking element secured to the supporting leg adjacent the end securing said single plate and below the single plate and extending outwardly therefrom a preselected distance to permit another similarly defined seating frame to be stacked therewith by engaging the V-notch of the single plate of said another seating frame at the stacking element to permit them to be stacked in a spaced apart relationship in accordance with said preselected distance.

10. A seating frame as defined in claim 9 including individual seating means secured to said plate means.

11. A settee-cluster frame comprising a frame rail of unitary construction comprising a first rail tubular section having a preselected length for supporting a bench-type seating unit thereon, said first rail section including means secured thereto and extending outwardly therefrom in a substantially transverse direction from the first rail section for receiving and securing a bench-type seating unit thereon in conjunction with the first rail section, a second rail tubular section having a straight portion with one end thereof extending at a preselected acute angle with respect to the longitudinal center line of the straight portion of the second tubular section, means for securing the remaining end of the second rail tubular section to the first rail tubular section adjacent one end thereof and in a horizontal plane spaced a preselected distance below the horizontal plane of the first rail tubular section, a first supporting leg tubular element secured adjacent the opposite end of the first tubular section from the second rail tubular section for supporting the first tubular section in a preselected horizontal plane a preselected distance above the supporting surface therefor, a second supporting leg tubular element secured to said one end of the second tubular section intermediate the ends thereof for supporting the second tubular section a preselected distance above the supporting surface therefor in a horizontal plane parallel to the horizontal plane of the first tubular section but spaced a preselected distance below same, said second supporting leg includes stacking means for receiving the seating unit plate means of a similarly defined settee-cluster frame in a stacked relationship but longitudinally displaced, said seating unit plate means is constructed and defined to be received at said stacking means when stacked thereto, and wherein said means secured to said first rail section for receiving and securing a bench seating unit includes stacking means for receiving the same means of a similarly defined settee-cluster frame in said stacked and displaced relationship, plate means secured to the end of the second supporting leg element extending above the horizontal plane of the second rail section and constructed and defined for supporting and securing an individual seating unit thereon, a table supporting tubular element secured at one end to the second rail tubular section intermediate the ends of the straight portion of the second rail tubular section and extending outwardly thereof at a preselected acute angle above the horizontal plane of the second rail tubular section, the table supporting means and the acute angle for said end of the second rail tubular section extending to the same side of the longitudinal centerline of the straight portion of the second rail tubular section, plate means secured to the remaining end of the table supporting tubular element for supporting and securing a table top individual to the seating units mounted to the settee-cluster frame, said table supporting plate means is secured to the table supporting tubular element adjacent an edge of the plate means intermediate the ends of said edge of the plate means to thereby extend in the same direction as the table supporting element, and means secured to the end of the first rail tubular section and extending outwardly therefrom in a direction opposite to the first supporting leg tubular element that is constructed and defined to permit the thus defined settee-cluster frame to be securable to a substantially vertically extending mounting structure to maintain the frame in said horizontal relationship.

* * * * *